US007364413B2

(12) United States Patent
Nieter

(10) Patent No.: US 7,364,413 B2
(45) Date of Patent: Apr. 29, 2008

(54) RECIPROCATING COMPRESSOR WITH ENLARGED VALVE SEAT AREA

(75) Inventor: Jeffrey J. Nieter, Coventry, CT (US)

(73) Assignee: Carrier Corporation, Syracuse, NY (US)

( * ) Notice: Subject to any disclaimer, the term of this patent is extended or adjusted under 35 U.S.C. 154(b) by 763 days.

(21) Appl. No.: 10/681,762

(22) Filed: Oct. 8, 2003

(65) Prior Publication Data

US 2005/0079081 A1 Apr. 14, 2005

(51) Int. Cl.
*F04B 53/10* (2006.01)
*F16K 15/16* (2006.01)

(52) U.S. Cl. ..... 417/567; 417/569; 137/855

(58) Field of Classification Search ..... 417/567, 417/569, 571, 560; 137/855
See application file for complete search history.

(56) References Cited

U.S. PATENT DOCUMENTS 5,370,156 A * 12/1994 Peracchio et al. ..... 137/856
5,672,053 A 9/1997 Sabha
5,884,665 A 3/1999 Thurston
6,318,980 B1 11/2001 Kurihara et al.
2002/0119059 A1 8/2002 Sato et al.

FOREIGN PATENT DOCUMENTS

| | | |
|---|---|---|
| DE | 3909343 | 9/1990 |
| EP | 0388633 | 9/1990 |
| GB | 371688 | 4/1932 |

OTHER PUBLICATIONS

International Search Report, Mar. 18, 2006.

* cited by examiner

*Primary Examiner*—Charles G Freay
(74) *Attorney, Agent, or Firm*—Carlson, Gaskey & Olds

(57) ABSTRACT

A reciprocating compressor is provided with a discharge valve having an area inward of a valve seat which is greater than the area of the discharge port. The valve seat also has a distinct shape compared to the valve port in preferred embodiments. The increased area within the valve seat results in an increased force tending to open the valve from a compressed fluid. On the other hand, since the valve port remains relatively small, the flow losses are not significantly increased.

8 Claims, 3 Drawing Sheets

RECIPROCATING COMPRESSOR WITH ENLARGED VALVE SEAT AREA

BACKGROUND OF THE INVENTION

This invention relates to a discharge valve and valve seat for a reciprocating compressor wherein the area inward of the valve seat is significantly larger than the area of the port leading to the discharge valve.

Reciprocating compressors typically include a piston movable within a cylinder. A valve plate at one end of the cylinder selectively allows a fluid to be compressed to flow into the cylinder through an inlet valve. The valve plate also includes a discharge valve to control the flow of the compressed fluid outwardly of the cylinder. In one common arrangement of the valve plate, the inlet valve is positioned at a radially outer location on the cylinder, while the discharge valve is positioned at a central location. The discharge valve is on an outer surface of the valve plate. A discharge port leads through the valve plate to the discharge valve. Typically, the discharge valve seats against a valve seat on the valve plate. The valve seat has typically surrounded the discharge port, such that an area defined inward of the valve seat is equal to or slightly larger than the area of the discharge port.

There are trade-offs in the design of the discharge valve for such compressors. In particular, the area of the discharge port is proportional to a quantity known as "flow loss." Flow loss represents a decrease in efficiency in that it represents fluid which has been compressed but which is not driven outwardly of the cylinder to a downstream use. That is, fluid in the discharge port at the time the piston reaches the end of its stroke is not driven further outwardly of the discharge valve. All of the energy put into this compressed fluid is "lost." For this reason, it is not beneficial to excessively increase the size of the discharge port.

On the other hand, it is the area within the valve seat that controls the amount of force applied from the compressed fluid to open the discharge valve and allow flow of the fluid outward of the chamber. In certain applications, it would be desirable to increase this force without dramatically increasing the pressure of the compressed fluid.

To date, the designers of reciprocating compressors have chosen some relative equal value for the area within the valve seat and the area of the discharge port based upon an evaluation of the applications to which the reciprocating compressor will be utilized. In fact, since many compressors are utilized across a wide range of operational applications, this trade off may not always be as beneficial as would be desired. The problem becomes particularly acute when an unique refrigerant such as $CO_2$ is utilized in a refrigerant cycle.

SUMMARY OF THE INVENTION

In disclosed embodiments of this invention, the valve seat is moved radially outwardly of the discharge port by a significant amount such that the area over which the compressed refrigerant is driven to open the discharge valve is significantly greater than the area of the discharge port. In this way, an increased force to open the discharge valve is achieved without significantly increasing the flow loss.

In a disclosed embodiment of this invention, the increased area is at least equal to the area of the discharge port. That is, the area inward of the valve seat is at least twice the area of the discharge port. In this way, the force on the valve is at least doubled without any significant increase in flow loss.

Various shapes may be utilized for the valve seat. In particular, a preferred valve seat has a shape that is distinct from the shape of the discharge port. In this manner, the area can be increased within the available space on the valve plate.

These and other features of the present invention can be best understood from the following specification and drawings, the following of which is a brief description.

DETAILED DESCRIPTION OF THE PREFERRED EMBODIMENT

Figure 1A:
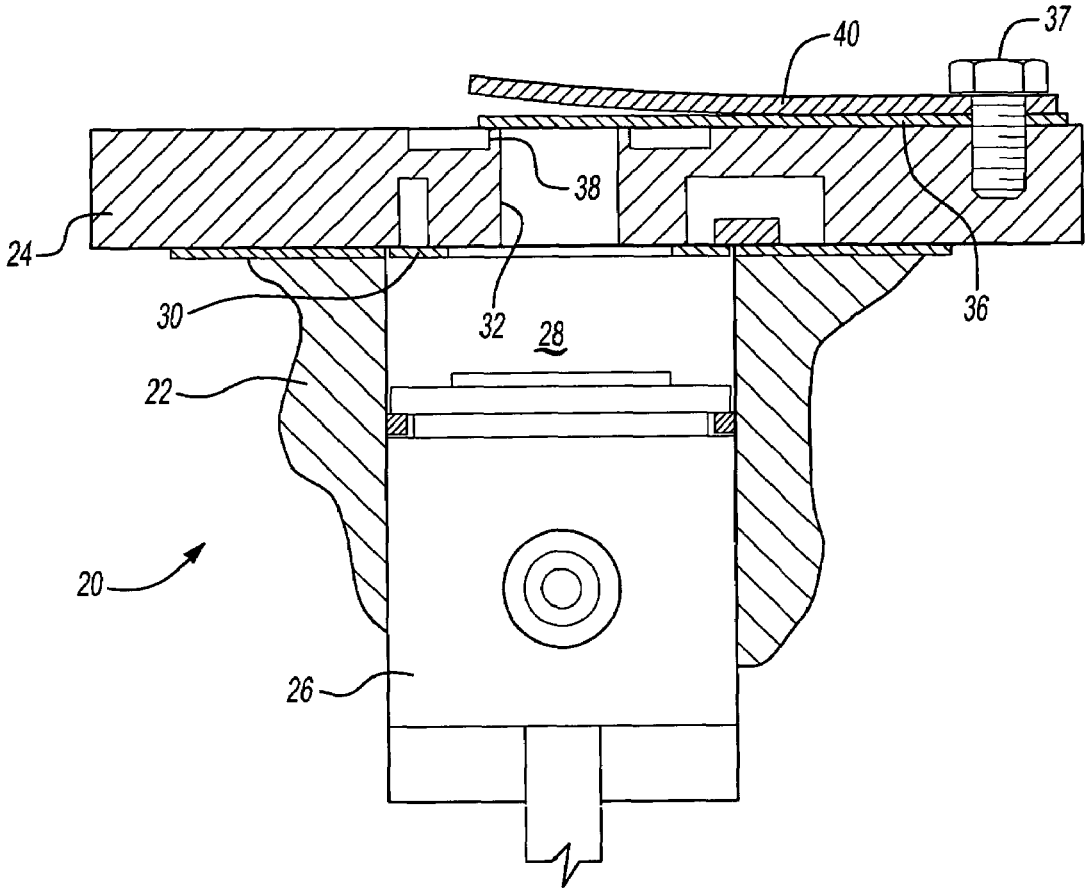
Fig-1A PRIOR ART
FIG. 1A is a cross-sectional view through a prior art compressor.

As shown in FIG. 1A, and as known in the prior art, a compressor 20 includes a cylinder head 22 and a valve plate 24. A piston 26 moves within the cylinder head 22 to compress a fluid received in a cylinder chamber 28. An inlet valve 30 selectively allows the flow of the fluid into the chamber 28. A discharge port 32 leads to a discharge finger valve 36. As known, the discharge finger valve 36 is pinned at one end 37 such that it may flex away from the port 32 and allow flow of the compressed refrigerant outwardly of the port 32. A stop 40 prevents undue movement of finger valve 36. The discharge valve 36 seats against a valve seat 38.

Figure 1B:
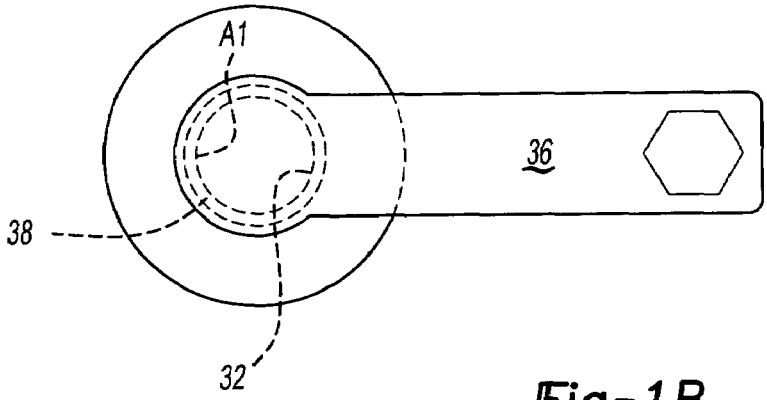
Fig-1B PRIOR ART
FIG. 1B shows the prior art discharge valve.

As can be appreciated from FIG. 1B, the area A1 inward of the valve seat 38 is equal to the area within the discharge port 32. Thus, the compressed fluid acting to open the discharge valve 36 is across an area equal to the area of the discharge port. The trade-off between losses and potentially low opening force, as mentioned above, are experienced by this prior art compressor.

Figure 2A:
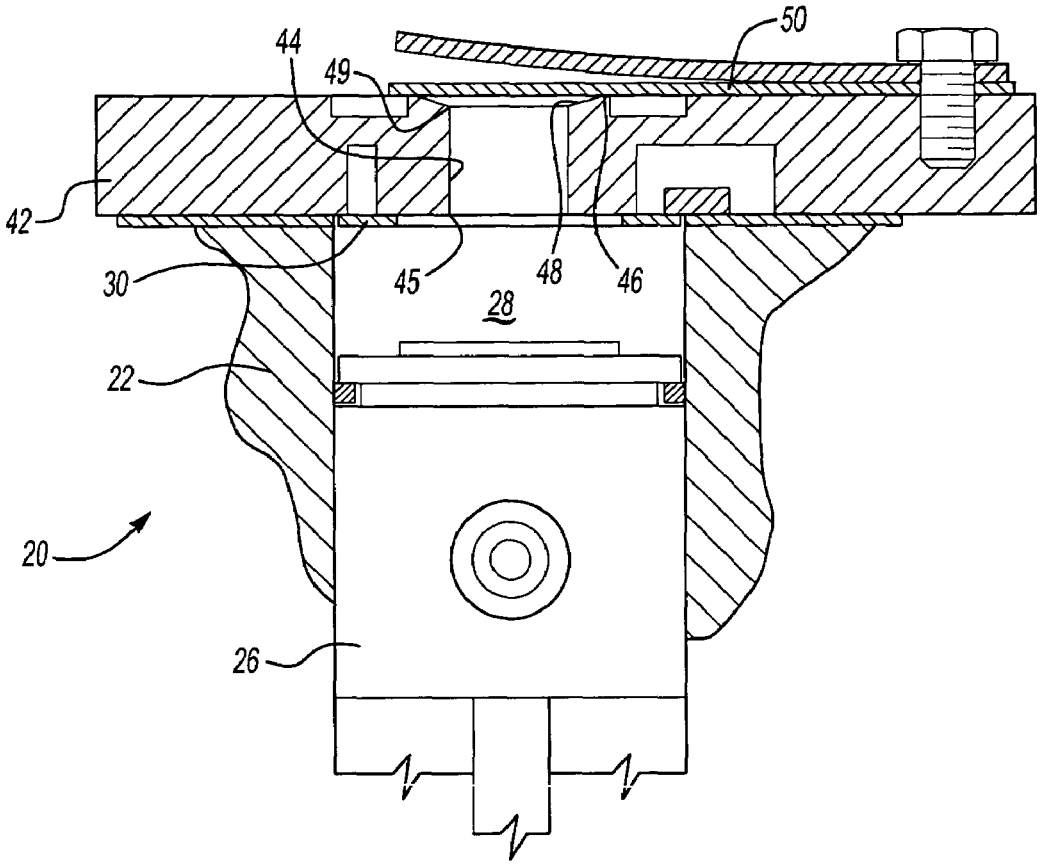
FIG. 2A is a cross-sectional view through an inventive compressor.

FIG. 2A shows a compressor valve plate 42 that has been modified in accordance with the present invention. The discharge port 44 has an area 45 at the end that communicates with the chamber 28 that is significantly smaller than the area inward of the valve seat 46. Again, a discharge finger valve 50 seats against the valve seat 46. However, a ramped increasing area 48 extends radially outwardly between an end 49 of the smaller discharge port area and the valve seat 46.

Figure 2B:
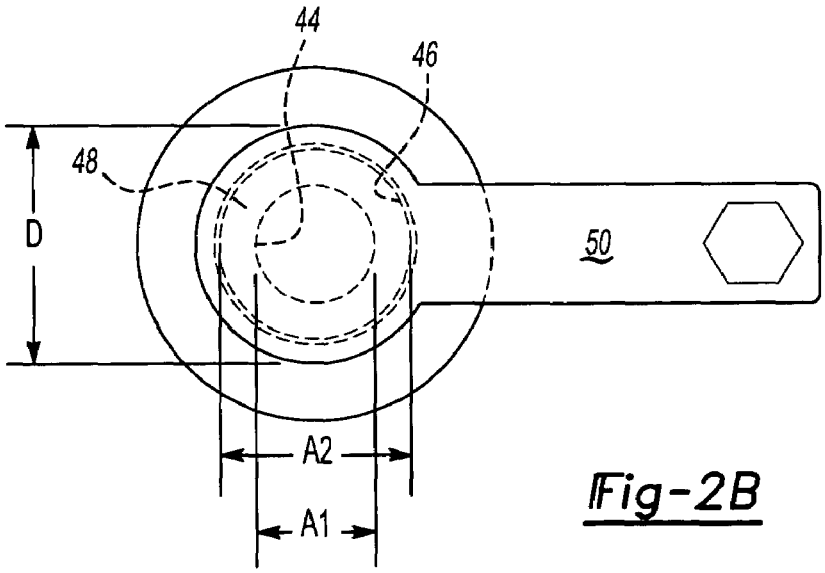
FIG. 2B is a top view of a first embodiment discharge valve.

As shown in FIG. 2B, there is now a significant increased area A2 which is significantly greater than the area of the discharge port Al. In preferred embodiments, this increase in area is at least equal to the nominal area of the discharge port A2. Thus, there is a significant increase in the force on the valve 50 tending to open the valve. Further, there is only a nominal increase in the fluid losses in that the increase in area is only over a very small volume past the end 49 of the nominal discharge port area A1.

The outside area of the valve D also limits somewhat the shape of the valve seat in that this area cannot be so great as it begins to impinge upon the surrounding structure. Aspects of the above invention, such as the distinct shape for the valve seat, allow tailoring of the outside area of the valve D to accommodate the other components that must extend within the valve plate.

Figure 3A:
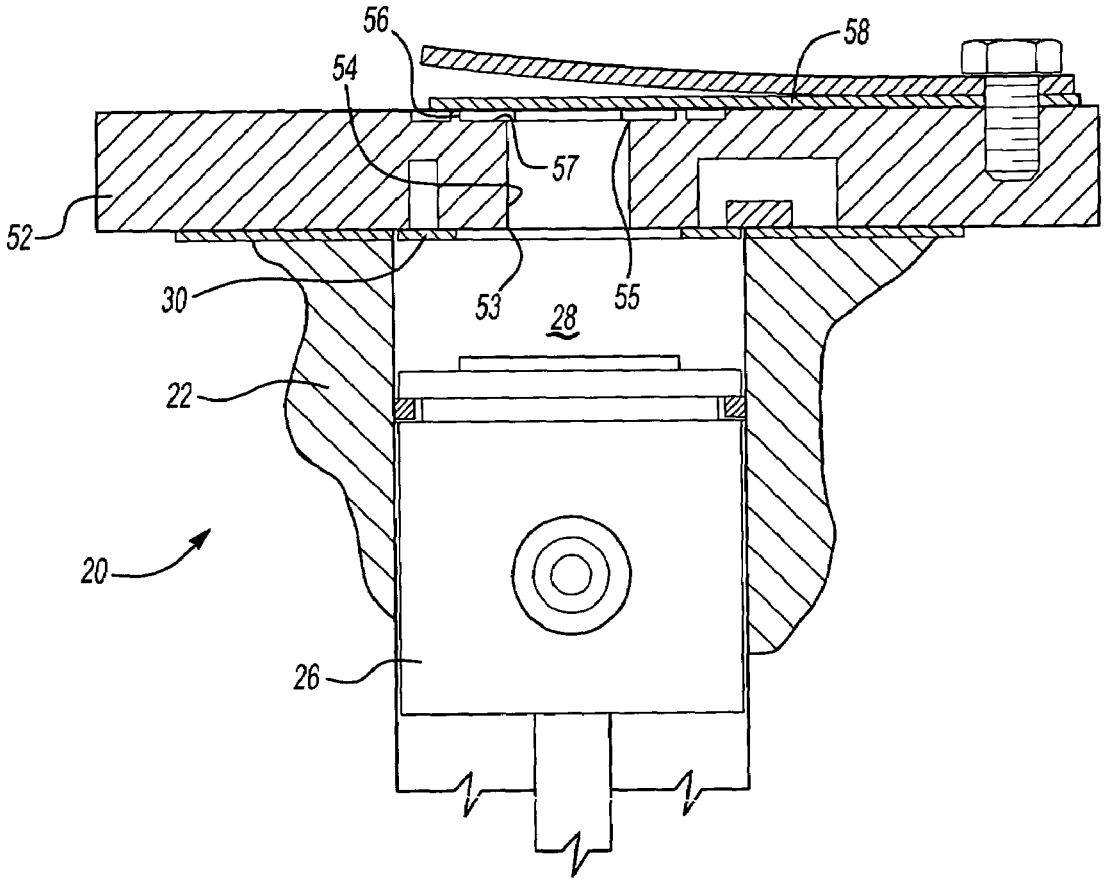
FIG. 3A is a cross-sectional view through a second embodiment compressor.
Figure 3B:
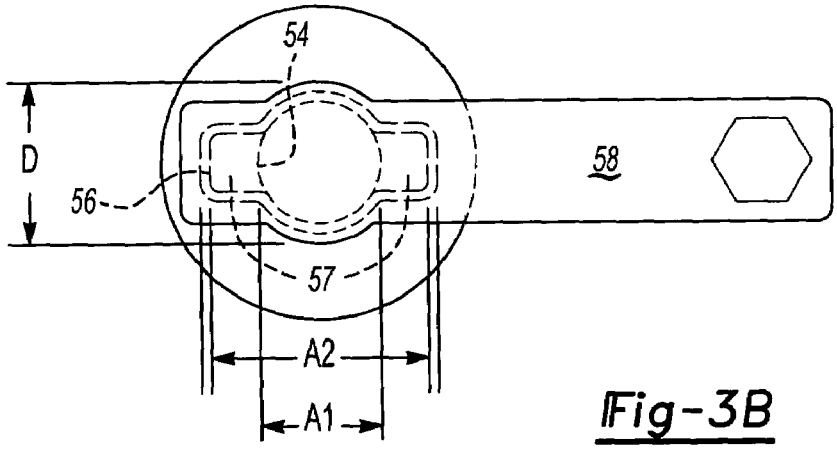
FIG. 3B is a top view of the second embodiment discharge valve.

FIG. 3A shows a second embodiment valve plate 52, having a discharge port 54 extending between ends 55 and 53. The valve seat 56 is positioned adjacent the end 55. There is an increased area shown at 57 in the FIG. 3A which acts on the valve 58. As can be appreciated from FIG. 3B, the shape of the valve seat 56 differs markedly from the shape of the discharge port 54. Thus, there is a significant increase in the area through which a fluid acts on the valve 58 to open the valve with only a small increase in the flow losses. The shape shown in FIG. 3B is a preferred shape with ears 56 at each side of the port 54 defining additional flow areas 57. While this shape is shown, other shapes such as ovals, rectangles, etc., may also be utilized. The ears 56 can be seen to be symmetric about a central plane that could be defined through the valve seat.

Here again, the increase in area is preferably of an order similar to the first embodiment.

Again, the inventive compressor is preferably utilized to compress a refrigerant for a refrigerant cycle, and most preferably to compress an unique refrigerant such as $CO_2$.

A preferred embodiment of this invention has been disclosed, however, a worker of ordinary skill in the art would recognize that certain modifications would come within the scope of this invention. For that reason, the following claims should be studied to determine the true scope and content of this invention.

What is claimed is:

1. A compressor comprising:

a cylinder head defining a chamber, and a valve plate mounted at an end of said cylinder head;

a piston reciprocating within said cylinder head toward and away from said valve plate;

an inlet valve for allowing flow of a fluid into said chamber;

a discharge valve for selectively allowing flow of a compressed fluid outwardly of said chamber, said discharge valve being positioned at an opposed end of a discharge port from said chamber, said discharge port having a first cross-sectional area, said discharge valve being flexible away from said discharge port in response to a force from the compressed fluid, and said discharge valve seating on a valve seat on said valve plate, an area defined inwardly of said valve seat is greater than said first cross-sectional area, said area defined inwardly of said valve seat being non-cylindrical;

said valve seat defining a shape inward of said valve seat which is distinct from a shape of said area of said discharge port; and said valve seat having a central circular area with two opposed ears extending radially outwardly from said circular area to define said increase in area over said first cross-sectional area.

2. A compressor as recited in claim 1, wherein said inlet valve also seating on valve seat.

3. A compressor a recited in claim 2, wherein said inlet valve is positioned radially outwardly of said discharge valve, with said discharge port generally being positioned near the center of said chamber.

4. A compressor as recited in claim 1, wherein said discharge port extends to a downstream end, and a ramp then extends to said valve seat, said valve seat being positioned radially outward of said downstream end of said discharge port.

5. A compressor as recited in claim 1, wherein said fluid is a refrigerant.

6. A compressor as recited in claim 5, wherein said refrigerant is $CO_2$.

7. A compressor as recited in claim 1, wherein said discharge valve is pinned at one end with the second end being flexible away from said discharge port.

8. A compressor comprising:

a cylinder head defining a chamber, and a valve plate mounted at an end of said cylinder head;

a piston reciprocating within said cylinder head toward and away from said valve plate;

an inlet valve for allowing flow of a fluid into said chamber;

a discharge valve for selectively allowing flow of a compressed fluid outwardly of said chamber, said discharge valve being positioned at an opposed end of a discharge port from said chamber, said discharge port having a first cross-sectional area, said discharge valve being flexible away from said discharge port is response to a force from the compressed fluid, and said discharge valve seating on a valve seat on said valve plate, an area defined inwardly of said valve seat is greater than said first cross-sectional area; and said area defined inwardly of said valve seat is greater than said area of said discharge port by at least 200%, and said area defined inwardly of said vale seat is both non-cylindrical, and symmetric, with there being a cylindrical portion and plural portions extending radially therefrom formed on spaced sides of a central plane of said area.

* * * * *

UNITED STATES PATENT AND TRADEMARK OFFICE

CERTIFICATE OF CORRECTION

PATENT NO. : 7,364,413 B2
APPLICATION NO. : 10/681762
DATED : April 29, 2008
INVENTOR(S) : Nieter It is certified that error appears in the above-identified patent and that said Letters Patent is hereby corrected as shown below:

Claim 2, Column 4, line 6: insert --a-- after "on" and before the second occurrence of "valve"

Claim 3, Column 4, line 7: "a" should read as --as--

Claim 8, Column 4, line 50: insert --first cross-sectional-- after "said" and before "area"

Signed and Sealed this

Nineteenth Day of August, 2008

JON W. DUDAS
*Director of the United States Patent and Trademark Office*